US006269168B1

(12) United States Patent
Tagami

(10) Patent No.: US 6,269,168 B1
(45) Date of Patent: Jul. 31, 2001

(54) SPEAKER APPARATUS

(75) Inventor: Takahisa Tagami, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/272,398

(22) Filed: Mar. 19, 1999

(30) Foreign Application Priority Data

Mar. 25, 1998 (JP) ..... 10-077832

(51) Int. Cl.[7] ..... H04R 25/00
(52) U.S. Cl. ..... 381/412; 381/420; 381/401
(58) Field of Search ..... 381/396, 398, 381/401, 402, 403, 404, 420, 422, 424, 431, 432, FOR 152, FOR 153, FOR 155, FOR 159, 300

(56) References Cited

U.S. PATENT DOCUMENTS

| | | | | |
|---|---|---|---|---|
| 2,122,587 | * | 7/1938 | Ringel | 381/401 |
| 2,698,917 | * | 1/1955 | Van Urk et al. | 381/420 |
| 2,699,472 | * | 1/1955 | Olson et al. | 381/401 |
| 3,665,124 | * | 5/1972 | Sotome | 381/401 |
| 4,122,314 | * | 10/1978 | Matsuda et al. | 381/421 |
| 4,550,430 | * | 10/1985 | Meyers | 381/401 |
| 4,590,333 | * | 5/1986 | Strohbeen | 381/401 |
| 5,214,710 | * | 5/1993 | Ziegenberg et al. | 381/199 |

FOREIGN PATENT DOCUMENTS

| | | | | |
|---|---|---|---|---|
| 0835040 | | 4/1998 | (EP) . | |
| 2261135 | | 5/1993 | (GB) . | |
| 4-88800 | * | 3/1992 | (JP) | 381/159 |

* cited by examiner

*Primary Examiner*—Curtis Kuntz
*Assistant Examiner*—P Dabney
(74) *Attorney, Agent, or Firm*—Jay H. Maioli

(57) ABSTRACT

A speaker apparatus for reproducing acoustic sounds includes a magnetic circuit unit having a substantially ring-shaped center plate of a magnetic material and a set of substantially annular magnets arranged on both sides of the center plate so that magnetic poles of repulsive polarities face each other with the center plate in-between. The magnetic circuit unit produces a magnetic field on each of an inner rim side and an outer rim side of the center plate. The speaker apparatus also includes a first vibrating system including a first vibrating plate arranged on the inner rim side of the center plate so as to be driven by the magnetic circuit unit, and a second vibrating system including a second vibrating plate arranged on the outer rim side of the center plate so as to be driven by the magnetic circuit unit. The first and second vibrating plates are substantially flat plate shaped and arranged so that their respective major surfaces lie on substantially the same horizontal plane. Since the first and second vibrating plates having respective different reproducing frequency ranges and are positioned on substantially the same horizontal plane, the reproduced acoustic sound may be improved in sound quality.

6 Claims, 5 Drawing Sheets

FIG.6B
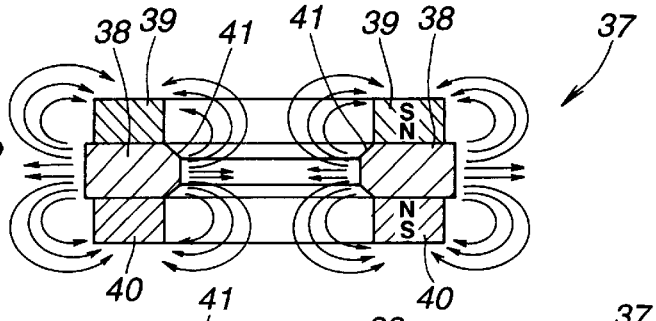
FIG.6A
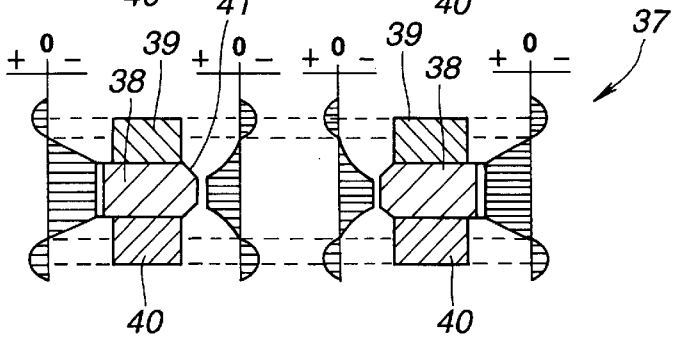
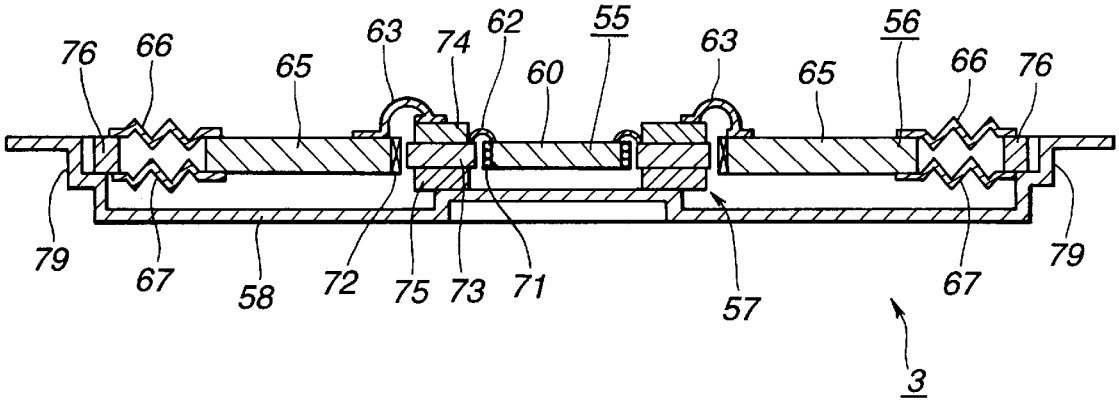
FIG.8

SPEAKER APPARATUS

BACKGROUND OF THE INVENTION

1. Field of the Invention

This invention relates to a speaker apparatus for transducing electrical signals into acoustic sound in which the apparatus can be reduced in thickness.

2. Description of the Related Art

There has hitherto been used a speaker apparatus in which the sound in the high frequency range and the sound in the mid to low frequency range are reproduced with respective different vibrating plates. As this speaker apparatus, there is proposed a coaxial two-way speaker apparatus in which a vibrating plate reproducing the sound of a high frequency range and another vibrating plate reproducing the sound of the mid to low frequency range are arranged superimposed with the centers in the vibrating direction coincident with each other.

As this type of speaker apparatus, one arranged as shown in FIG. 1 is proposed. A speaker apparatus 101, shown in FIG. 1, includes a vibrating system for the high sound range 105 for generating the acoustic sound of a high sound range, a magnetic circuit for high sound range 106 for driving the vibrating system for the high sound range 105, a vibrating system for the mid to low sound range 107 for generating the acoustic sound of a mid to low sound range, and a magnetic circuit for mid to low sound range 108 for driving the vibrating system for the vibrating system for the mid to low sound range 107.

The vibrating system for the high sound range 105 is supported by a frame 109 and includes a dome-shaped vibrating plate 110, a cylindrically-shaped bobbin 111, carrying one end of the vibrating plate 110, and a resilient edge 112 connected to the outer rim of the vibrating plate 110.

The magnetic circuit for high sound range 106 includes a voice coil 114, for vibrating the vibrating system for the high sound range 105, a yoke 115 for forming a magnetic path, a magnet 106 for according the magnetic flux to the yoke 115, and a top plate 117 provided adjacent to the magnet 116 for defining a magnetic gap. The voice coil 114 is provided on the outer periphery of the bobbin 111 of the vibrating system for the high sound range 105 within the magnetic gap. Both ends of the voice coil 114 are connected via a braided wire, not shown, to a connection terminal 110 provided on the outer rim of the frame 109. The yoke 115 is formed of a magnetic material in a disc shape and has an upstanding columnar center pole 118. This center pole 118 is inserted into the inside of the bobbin 111 of the vibrating system for the high sound range 105. The magnet 116, mounted on the yoke 115, has a ring shape into which is inserted the center pole 118. This magnet 116 has the yoke side and the top plate side magnetized to an S-pole and to an N-pole, respectively. The yoke 115 has its position adjacent to the S-pole side of the magnet 116 magnetized to an S-pole. The magnet 116, mounted on the yoke 115, has a ring shape, with a center opening into which is inserted the center pole 118. The top plate 117, magnetized to an N-pole, has a magnetic gap defined between its inner rim and the outer rim of the center pole 118.

The magnetic circuit 106 is covered by a shield cover 119 for prohibiting the magnetic flux from leaking from the magnetic circuit 106 to outside, as shown in FIG. 1.

Referring to FIG. 1, the vibrating system for the mid to low sound range 107 includes a substantially conically-shaped vibrating plate 120, having a center through-hole, a cylindrically-shaped bobbin 121, having its one end mounted in a through-hole in the vibrating plate 120, a resilient edge 122, connected to the outer rim of the vibrating plate 120, and a resilient vibration-absorbing damper 123 mounted on the bobbin 121.

Referring to FIG. 1, the magnetic circuit for mid to low sound range 108 includes a voice coil 124 for vibrating the vibrating system for the mid to low sound range 107, a yoke 125 forming a magnetic path, a driving magnet 126 for according the magnetic flux to this yoke 125, a top plate 127 provided adjacent to the driving magnet 126 for defining the magnetic gap and a cancelling magnet 128 for prohibiting the magnetic flux of the driving magnet 126 from leaking to outside of the magnetic circuit for mid to low sound range 108.

The voice coil 124 is provided on the outer rim of the bobbin 121 of the vibrating system for the mid to low sound range 107 within the magnetic gap. Both ends of the voice coil 124 are connected to the connection terminal 110 provided on the outer rim of the frame 109 via a braided wire 130. The yoke 125 is formed of a magnetic material in a disc shape and has an upstanding columnar center pole 131. This center pole 131 is inserted into the inside of the bobbin 121 of the vibrating system for the mid to low sound range 107. The driving magnet 126, provided on the yoke 125, has a ring shape with a center opening into which is inserted the center pole 131. This driving magnet 126 has the yoke side and the top plate side magnetized to an S-pole and to an N-pole, respectively. The yoke 125 has its position adjacent to the S-pole side of the driving magnet 126 magnetized to an S-pole. The top plate 127, mounted on the driving magnet 126, has a ring shape into which is inserted the center pole 131. The top plate 127, magnetized to an N-pole, has a magnetic gap defined between its inner rim and the outer rim of the center pole 118. The cancelling magnet 128 has a ring shape and is provided on the rear end of the yoke 125. The cancelling magnet 128 has the yoke side and the rear end magnetized to the S-pole and to the N-pole, respectively.

This speaker apparatus 101 has a frame 109 supporting the vibrating system for the mid to low sound range 107, as shown in FIG. 1. This frame 109 is formed of a metallic material and substantially conically shaped and flared from the rear end towards the front end. The frame 109 has, on its front end side, a holder 132 for holding the vibrating system for the mid to low sound range 107. To this holder 132 is secured the outer rim of the edge 122 of the vibrating system for the mid to low sound range 107 via a gasket, not shown.

In the above-described speaker apparatus 101, if the current is fed to the voice coils 114, 124, the voice coils 114, 124 are set into vibrations and, in keeping with the vibrations of the voice coils 114, 124, the vibrating plates 110, 120 of the vibrating system for the high sound range 105 and the vibrating system for the mid to low sound range 107 are set into vibrations to produce the acoustic sound.

Referring to FIG. 2, a modified speaker apparatus 102, having a vibrating system for the high sound range 135 and a magnetic circuit for high sound range 136 different from those of the above-described speaker apparatus 101, is explained. Since the vibrating system for the mid to low sound range and the magnetic circuit for mid to low sound range of the speaker apparatus 102 are similar to the vibrating system for the mid to low sound range 107 and to the magnetic circuit for mid to low sound range 108 of the above-described speaker apparatus 101, shown in FIG. 2, corresponding parts are depicted by the same reference numerals and are not explained specifically.

Referring to FIG. 2, the vibrating system for the high sound range 135 is supported by the magnetic circuit for mid to low sound range 108, and includes a dome-shaped vibrating plate 140, a cylindrically-shaped bobbin 141, carrying one end of the vibrating plate 140, and a resilient edge 142 connected to the outer rim of the vibrating plate 140.

The magnetic circuit for high sound range 136 includes a voice coil 144, for vibrating the vibrating system for the high sound range 135, a bottomed tubular yoke 145 for forming a magnetic path, a magnet 146 for according the magnetic flux to the yoke 145, and a top plate 147 provided adjacent to the magnet 146 for defining a magnetic gap. The voice coil 144 is provided on the outer periphery of the bobbin 141 of the vibrating system for the high sound range 135 within the magnetic gap. Both ends of the voice coil 144 are connected via a braided wire, not shown, to a connection terminal 110 provided on the outer rim of the frame 109. The yoke 145 is formed of a magnetic material. This magnet 146 has the yoke side and the top plate side magnetized to an S-pole and to an N-pole, respectively. The yoke 145 has its position adjacent to the S-pole side of the magnet 146 magnetized to an S-pole. The top plate 147, mounted on the magnet 146, is formed of a magnetic material in a disc shape. This top plate 147, delimiting a magnetic gap between its outer rim and the inner rim of the opening end of the yoke 145, is magnetized to an N-pole.

In the above-described speaker apparatus 102, if the current is fed to the voice coils 124, 144, the voice coils 124, 144 are set into vibrations and, in keeping with the vibrations of the voice coils 124, 144, the vibrating plates 140, 120 of the vibrating system for the high sound range 135 and the vibrating system for the mid to low sound range 107 are set into vibrations to produce the acoustic sound.

The above-described conventional speaker apparatus 101 has a drawback that the sound source for the high frequency range obstructs the reproduced sound of the sound source for the mid to low frequency range to affect reproduced sound pressure versus frequency characteristics.

Thus, it is in general critical to approach and match the mounting positions of the sound source for the high frequency range and the sound source for the mid to low frequency range to each other. However, this speaker apparatus 101 has a drawback that the positions of the voice coils 114, 124 constituting the respective sound sources are spaced apart in the fore-and-aft direction in the amplitude direction, as shown in FIG. 1.

In the above-described speaker apparatus 102, since the sound source for the high frequency range is separated from the amplitude plane of the vibrating plate 120 of the sound source for the mid to low frequency range, as shown in FIG. 2, the sound source for the high frequency range is prevented from affecting the reproduced sound pressure versus frequency characteristics. However, this speaker apparatus 102 is not desirable in that the sound sources are not positioned in the same plane relative to the playback sound pressure direction.

The above-described speaker apparatus 101, 102 suffer from the problem that the magnet of a larger magnetic power is used to reduce the size of the sound source for higher frequency range, thus raising the production cost. These speaker apparatus 101, 102 are inconvenient in that a magnetic circuit for the sound source for higher frequency range has to be provided separately to increase the number of component parts to detract from ease in assembling.

SUMMARY OF THE INVENTION

It is therefore an object of the present invention to provide a novel speaker apparatus free from the above-mentioned problems inherent in the conventional electro-acoustic transducer.

It is another object of the present invention to provide a speaker apparatus that is able to reproduce the acoustic sound with high sound quality.

It is yet another object of the present invention to provide a speaker apparatus in which the structure is simplified and the apparatus itself can be reduced in thickness and size.

In one aspect, the present invention provides a speaker apparatus including a magnetic circuit unit having a substantially ring-shaped center plate of a magnetic material and a set of substantially annular magnets arranged on both sides of the center plate so that magnetic poles of repulsive polarities face each other with the center plate in-between. The magnetic circuit unit produces a magnetic field on each of an inner rim side and an outer rim side of the center plate. The speaker apparatus also includes a first vibrating system having a first vibrating plate which is arranged on the inner rim side of the center plate so as to be driven by the magnetic circuit unit, and a second vibrating system having a second vibrating plate which is arranged on the outer rim side of the center plate so as to be driven by the magnetic circuit unit.

The first and second vibrating systems may be of different reproducing frequency ranges.

In another aspect, the present invention provides a speaker apparatus including a magnetic circuit unit having a substantially ring-shaped center plate of a magnetic material and a set of substantially annular magnets arranged on both sides of the center plate so that magnetic poles of repulsive polarities face each other with the center plate in-between. The magnetic circuit unit produces a magnetic field on each of an inner rim side and an outer rim side of the center plate. The speaker apparatus also includes a first vibrating system including a first vibrating plate arranged on the inner rim side of the center plate so as to be driven by the magnetic circuit unit, and a second vibrating system including a second vibrating plate arranged on the outer rim side of the center plate so as to be driven by the magnetic circuit unit. The first and second vibrating plates are substantially flat plate shaped and arranged so that respective major surfaces thereof lie on substantially the same horizontal plane.

The first and second vibrating plates are arranged on the same axial line.

With the present speaker apparatus, since the first and second vibrating plates are positioned on substantially the same horizontal plane, the reproduced acoustic sound may be improved in sound quality.

Other objects and advantages of the present invention will become apparent from the following description of the preferred embodiments and the appended claims.

BRIEF DESCRIPTION OF THE DRAWINGS

FIGS. 6A and 6B are cross-sectional views showing a center plate constituting a magnetic circuit employed in the speaker apparatus embodying the present invention.

FIG. 8 is a cross-sectional showing a speaker apparatus according to yet another embodiment of the present invention.

DESCRIPTION OF THE PREFERRED EMBODIMENTS

Figure 1:
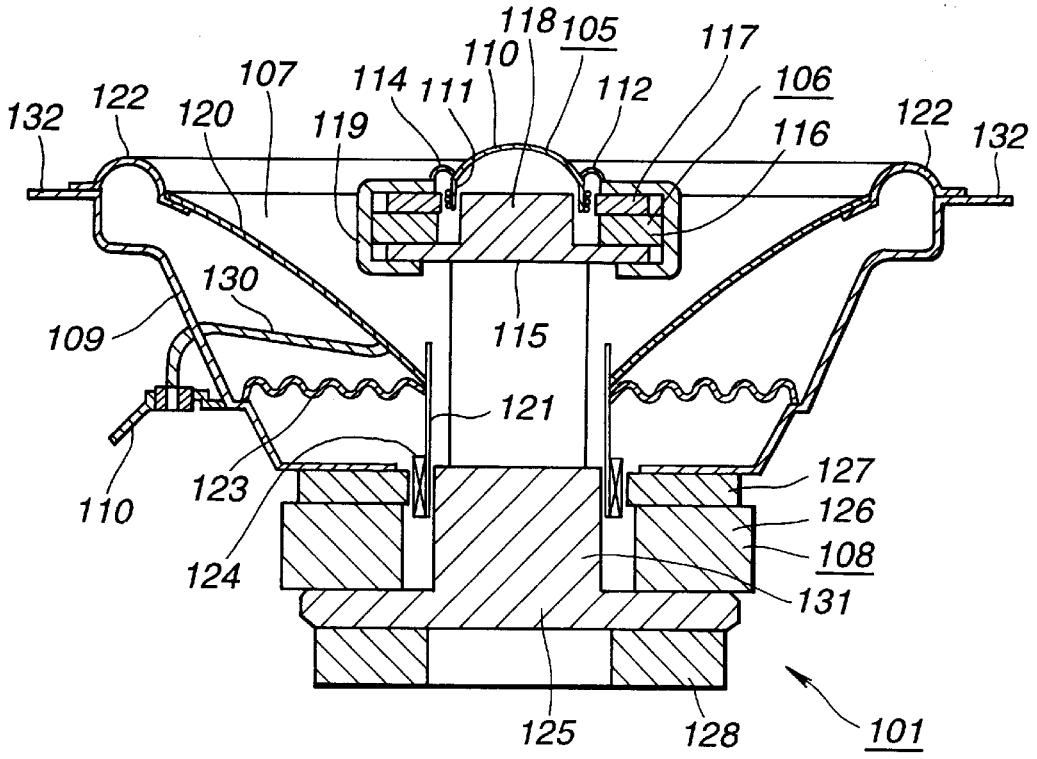
FIG.1 (PRIOR ART)
FIG. 1 is a cross-sectional view showing a conventional speaker apparatus.
Figure 2:
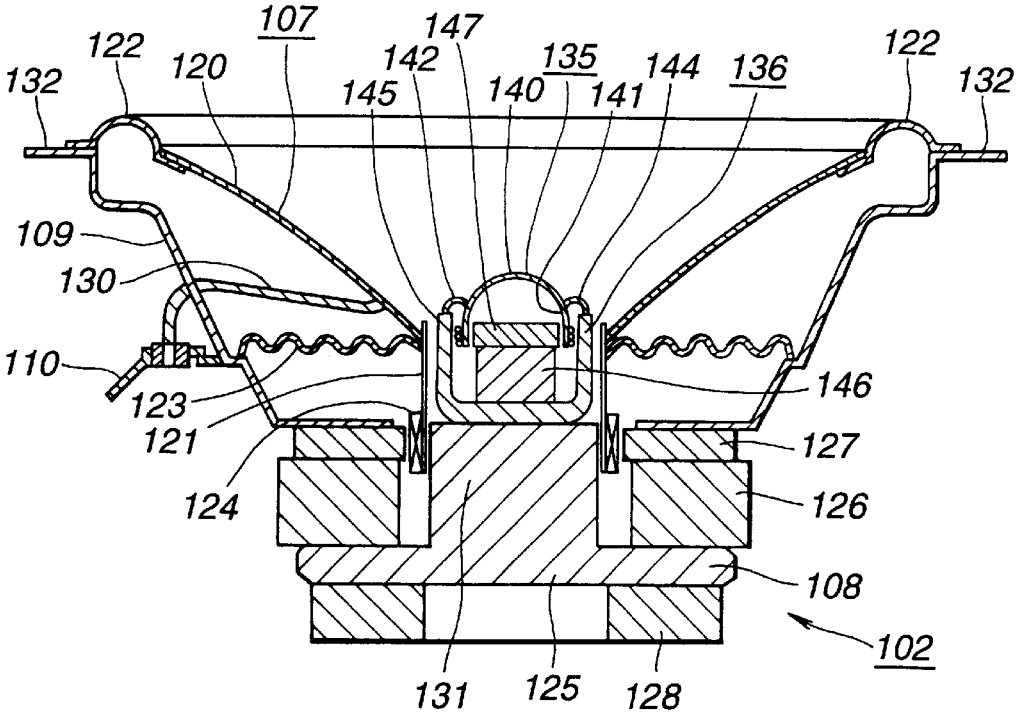
FIG.2 (PRIOR ART)
FIG. 2 is a cross-sectional view showing another conventional speaker apparatus.

Referring to the drawings, preferred embodiments of the speaker apparatus according to the present invention will be explained in detail.

Figure 3:
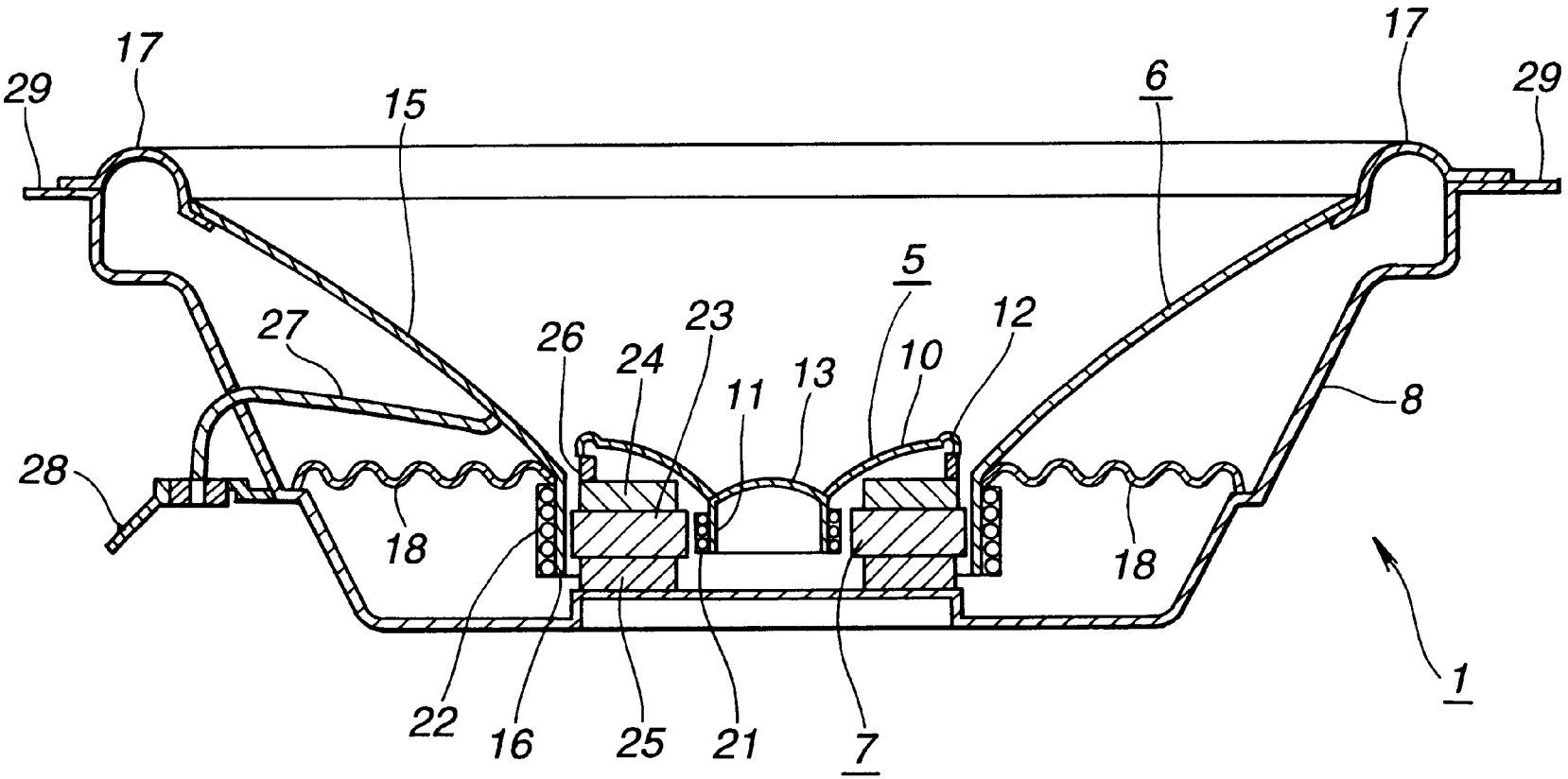
FIG. 3 is a cross-sectional showing a speaker apparatus according to an embodiment of the present invention.

A speaker apparatus 1 according to the present invention includes a vibrating system for the high sound range 5 for generating the acoustic sound of a high sound range, a vibrating system for the mid to low sound range 6 and a magnetic circuit 7 for driving the vibrating system for the high sound range 5 and the vibrating system for the mid to low sound range 6, as shown in FIG. 3. This speaker apparatus 1 includes a frame 8 for supporting the vibrating system for the high sound range 5, vibrating system for the mid to low sound range 6 and the magnetic circuit 7, as shown in FIG. 3.

The vibrating system for the high sound range 5 includes a substantially conically-shaped vibrating plate 10, having a center through-hole, a cylindrically-shaped bobbin 11, having its one end attached to the through-hole in the vibrating plate 10, a resilient edge 12 connected to the outer periphery of the vibrating plate 10 and a dome-shaped cap 13 mounted on the vibrating plate 10 for closing its through-hole, as shown in FIG. 3.

The vibrating system for the mid to low sound range 6 includes a substantially conically-shaped vibrating plate 15, having a center through-hole, a cylindrically-shaped bobbin 16, having its one end attached to the through-hole in the vibrating plate 15, a resilient edge 17 connected to the outer periphery of the vibrating plate 15, and a resilient vibration-absorbing damper 18, mounted on the bobbin 16, as shown in FIG. 3.

The driving circuit 7 includes first and second voice coils 21, 22 for vibrating the vibrating plates 10, 15 of the vibrating system for the high sound range 5 and the vibrating system for the mid to low sound range 6, respectively, a center plate 23 for constituting a magnetic path and a magnet set comprised of a first magnet 24 and a second magnet 25 for according the magnetic flux to the center plate 23.

The first voice coil 21 is provided on the outer rim of the bobbin 11 of the vibrating system for the high sound range 5 and is arranged on the inner rim of the magnetic circuit 7. Both ends of the first voice coil 21 are connected via a braided wire 27 to a connection terminal 28 provided on the outer rim of the frame 8. The second voice coil 22 is provided on the outer rim of the bobbin 16 of the vibrating system for the mid to low sound range 6 and is arranged on the outer rim of the magnetic circuit 7. Both ends of the second voice coil 22 are connected via braided wire 27 to the connection terminal 28 provided on the outer rim of the frame 8.

The center plate 23 is formed of a magnetic material, such as hot forged steel plate, into a ring shape, and is provided on the inner rim of the bobbin 16 of the vibrating system for the mid to low sound range 6.

The first and second magnets 24, 25 are anisotropic sintered magnets of rare earth elements, such as neodymium, and are each formed in a ring shape. Each of the first and second magnets 24, 25 has its outer diameter slightly smaller than the outer diameter of the center plate 23, while having the inner diameter of the center opening thereof slightly larger than the inner diameter of the center opening of the center plate 23. The first and second magnets 24, 25 are arranged with the center openings thereof coincident with the center opening of the center plate 23, so that the outer rim and the inner rim of the center plate 23 are protruded from the outer rims and the center openings of the first and second magnets 24, 25, respectively. The first and second magnets 24, 25 are arranged on both sides of the center plate 23 so that the magnetic poles of repulsive polarities face each other with the center plate 23 in-between. Specifically, each of the first and second magnets 24, 25 has the center plate side along the direction of thickness magnetized to the N-pole, while having the opposite side magnetized to an S-pole. Therefore, the magnetic circuit 7 forms a repellent magnetic field.

To the magnetic circuit 7, constructed as described above, an outer rim of an edge 12 of the vibrating system for the high sound range 5 is fixedly mounted via an edge ring 26 provided on the first magnet 24. On the outer rim and the inner rim of the magnetic circuit 7 are arranged a bobbin 16 of the vibrating system for the mid to low sound range 6 and the bobbin of the vibrating system for the high sound range 5, respectively, as shown in FIG. 3.

The frame 8, formed of a metallic material, is substantially conically shaped so that it is flared from the rear end side towards the front end side, as shown in FIG. 3. On the front end side of the frame 8, there is formed a holder 29 for holding the vibrating system for the mid to low sound range 6. To this holder 29 is secured the outer rim of an edge 17 of the vibrating system for the mid to low sound range 6 by a gasket, not shown. On the outer rim of the frame 8, there is mounted a connection terminal 28 connected to the first and second voice coils 21, 22 via braided wire 27. To this connection terminal 28 is connected a connection line of an external speech signal source, not shown.

With the above-described speaker apparatus 1, if the driving current proportionate to the speech signals is fed to the first and second voice coils 21, 22 of the magnetic circuit 7, the first and second voice coils 21, 22 are set into vibrations, in accordance with the Flemings left hand rule. The vibrating plates 10, 15 of the vibrating system for the high sound range 5 and the vibrating system for the mid to low sound range 6 are vibrated in keeping with the vibrations of the first and second voice coils 21, 22 to produce the acoustic sound.

The magnetic flux distribution of the magnetic circuit 7, constructed as described above, is explained with reference to FIG. 4A, in which the ordinate and the abscissa denote the position in the direction of thickness of the magnetic circuit 7 parallel to the amplitude direction of the vibrating system for the high sound range 5 and the vibrating system for the mid to low sound range 6, respectively. Also, in FIG. 4*b*, the arrows indicate the direction of the magnetic lines of force.

Figure 4B:
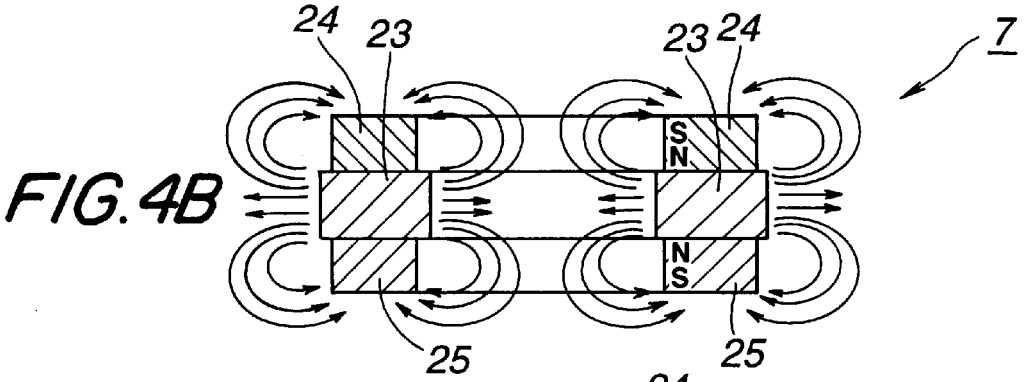
FIGS. 4A and 4B are cross-sectional views for illustrating the magnetic field of a magnetic circuit provided on the speaker apparatus of FIG. 3.
Figure 4A:
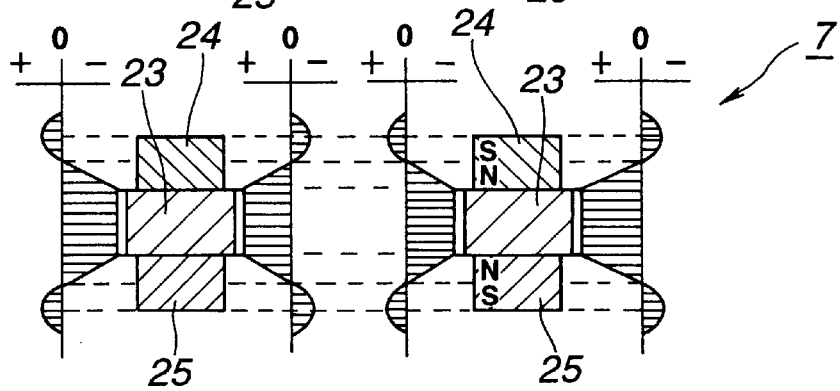

On the inner and outer rims of the magnetic circuit 7, there are formed magnetic fields of approximately equal magnetic flux densities, as shown in FIG. 4*b*. This magnetic circuit 7 has the maximum magnetic flux density in the magnetic field at a position facing the outer rim of the center plate 23, as shown in FIG. 4A. The magnetic flux density of the magnetic circuit 7 is progressively smaller in a direction away from the center plate 23 in the direction of thickness, with the direction of the magnetic flux being reversed at a mid portion along the direction of thickness of the first and second magnets 24, 25.

Also, in this magnetic circuit 7, the magnetic flux in the reverse direction is progressively increased in a direction proceeding away from the center plate in the direction of thickness from the center in the direction of thickness of the first and second magnets 24, 25, while being progressively smaller in the direction proceeding away from the ends of the first and second magnets 24,25. The magnetic circuit 7 sets the vibrating system for the high sound range 5 and the vibrating system for the mid to low sound range 6, arranged on the inner and outer rim sides, respectively.

A conventional magnetic circuit 200, providing a repellant magnetic field, is explained with reference to FIGS. 5A and 5*b*. The magnetic circuit 200 includes a disc-shaped center plate 201, formed of a magnetic material, and a magnet set, namely a first magnet 202 and a second magnet 203, arranged on both sides of the center plate 201 so that the magnetic poles of repulsive polarities will face each other with the center plate 201 in-between. Each of the first and second magnets 202, 203 has its center plate side along the direction of thickness thereof magnetized to an N-pole, while having its opposite side magnetized to an S-pole.

Figure 5B:
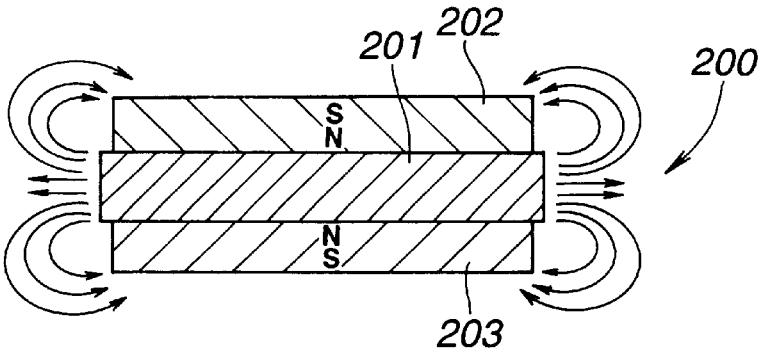
FIGS. 5A and 5B are cross-sectional views for illustrating the magnetic field of a magnetic circuit provided on the conventional speaker apparatus.
Figure 5A:
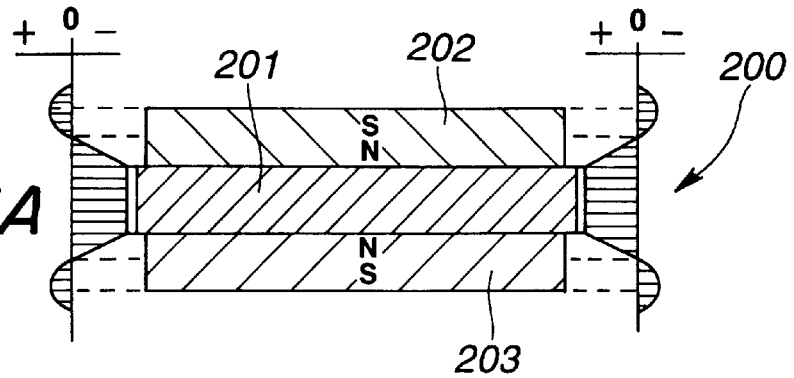

In the conventional magnetic circuit 200, the magnetic field is formed only in the outer rim of the disc-shaped center plate 201, as shown in FIG. 5B. In the magnetic circuit 7 of the present invention, the magnetic field is formed on the inner and outer rims of the center plate 23, as shown in FIG. 4B, and hence the vibrating system for the high sound range 5 and the vibrating system for the mid to low sound range 6, arranged on the inner and outer rim sides of the center plate 23, respectively, can be arranged on substantially the same plane.

Meanwhile, the speaker apparatus 1 according to the present invention may be provided with a magnetic circuit 37 configured as shown in FIGS. 6A and 6B.

This magnetic circuit 37 includes a ring-shaped center plate 38 of a magnetic material, and a magnet set, namely a first magnet 39 and a second magnet 40, arranged on both sides of the center plate 23 so that the magnetic poles of repulsive polarities will face each other with the center plate 23 in-between. Each of the first and second magnets 39, 40 has its center plate side along the direction of thickness thereof magnetized to an N-pole, while having its opposite side magnetized to an S-pole.

On the inner rim of the center plate 38 provided on the magnetic circuit 37 is formed a chamfered portion 41 extending across both corners on both sides in the direction of thickness thereof. That is, the center plate 38 has the width of the inner peripheral surface in a direction parallel to the amplitude direction of the vibrating plate 10 smaller than the width of its outer peripheral surface. Thus, with the center plate 38 of the magnetic circuit 37, the width of its inner peripheral surface in a direction parallel to the amplitude direction of the vibrating plate 10 is reduced, whereby the magnetic flux of the inner rim acting on the voice coil 21 for vibrating the vibrating system for the high sound range 5 not in need of the larger amplitude is concentrated at a mid portion in the thickness direction. It is noted that the inner rim of the center plate 38 need not only be chamfered since any other suitable configuration, such as arcuate cross-section, may be used if it permits concentration of the magnetic flux of the inner rim.

With the above-described speaker apparatus 1, in which the magnetic circuit 7 includes a ring-shaped center plate 23 and the first and second magnets 24, 25, arranged on both sides of the center plate 23 with the magnetic poles of repulsive polarities facing each other, the magnetic fields are formed on the inner and outer rims of the center plate 23, so that the vibrating system for the high sound range and the vibrating system for the mid to low sound range can be arranged on the same plane with respect to the playback sound pressure direction. Thus, the present speaker apparatus 1 represents a coaxial two-way type speaker apparatus in which the sound source positions of the playback sound pressure of the high sound range accurately coincides with that of the playback sound pressure of the low sound range.

Also, with the speaker apparatus 1 according to the present invention, plural magnetic circuits are not necessitated, thus correspondingly simplifying the structure, so that the laborious assembling operation of combining two magnetic circuits as in the case of the above-mentioned conventional speaker apparatus 101, 102 is eliminated, thus improving the ease in assembling.

Although the above-described speaker apparatus is configured so that its vibrating system for the high sound range 5 has the cone-shaped vibrating plate 10. Alternatively, the vibrating system for the high sound range may be provided with a dome-shaped vibrating plate 46. In a speaker apparatus 2, shown in FIG. 7, the parts other than a vibrating system for the high sound range 45 are similar to those of the above-described speaker apparatus 1 and hence depicted by the same reference numerals. Therefore, detailed description therefor is not made for simplicity.

Figure 7:
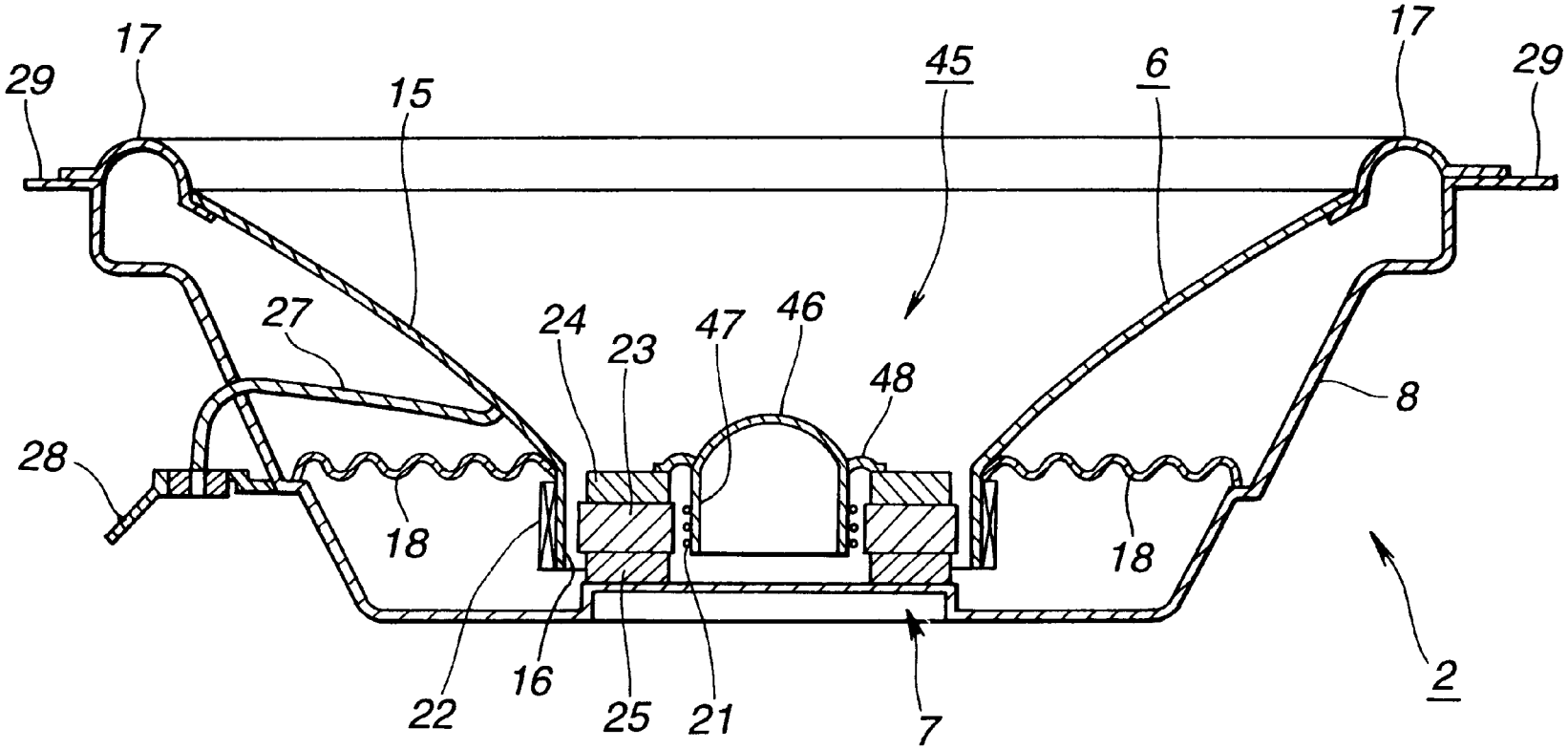
FIG. 7 is a cross-sectional showing a speaker apparatus according to another embodiment of the present invention.

Referring to FIG. 7, the vibrating system for the high sound range 45 provided on the speaker apparatus 2 is supported on the magnet 24 of the magnetic circuit 7, and includes a dome-shaped vibrating plate 46, a cylindrically-shaped bobbin 47, carrying one end of the vibrating plate 46, and a resilient edge 48 connected to the outer rim of the vibrating plate 46. On the outer periphery of the bobbin 47 is placed the voice coil 21 of the magnetic circuit 7 so that the bobbin 47 is arranged on the inner rim of the magnetic circuit 7.

In the above-described vibrating system for the high sound range 45, the current is fed to the voice coil 21 of the magnetic circuit 7, whereby the voice coil 21 is vibrated in keeping with the vibrations of the voice coil 21 to generate the acoustic sound.

In the above-described speaker apparatus 1, 2, the so-called cone-shaped vibrating plates 10, 15 are used for the vibrating system for the high sound range 5 and the vibrating system for the mid to low sound range 6, respectively. Another speaker apparatus 3 having a substantially planar vibrating plate is hereinafter explained.

This speaker apparatus 3 has a vibrating system for the high sound range 55, a vibrating system for the mid to low sound range 56 and a magnetic circuit 57 for driving the vibrating system for the high sound range 55 and the vibrating system for the mid to low sound range 56.

Referring to FIG. 8, the speaker apparatus 3 includes a frame 58 having the vibrating system for the high sound range 55, the vibrating system for the mid to low sound range 56 and the magnetic circuit 57. The vibrating system for the high sound range 55 includes a disc-shaped vibrating plate 60 and a resilient supporting member 62 for movably supporting the outer rim of the vibrating plate 60.

The vibrating plate 60 is formed to a desired thickness by a lightweight flat plate of a honeycomb structure or a foamed structure having voids in the inside or in the surface, such as a foamed mica structure. This vibrating plate 60 is arranged on the inner rim side of the magnetic circuit 57. The resilient supporting member 62 is formed of an elastic material to a substantially ring shape, as shown in FIG. 8. The resilient supporting member 62 has its inner rim portion attached to the outer rim of the vibrating plate 60, while having its outer rim attached to the inner rim of the magnetic circuit 57.

Referring to FIG. 8, the vibrating system for the mid to low sound range 56 includes a ring-shaped vibrating plate 65, having a center through-hole, a set of substantially ring-shaped resilient supporting members 66, 67 for movably supporting the outer rim of the vibrating plate 65, and a cap 63 for movably supporting the inner rim of the vibrating plate 65. The vibrating plate 65 is formed by a lightweight planar sheet member of a desired thickness having a honeycomb structure or a foamed structure presenting voids in the interior or in its surface, such as a foamed mica structure. Within the through-hole of the vibrating plate 65 is mounted a magnetic circuit 57. The resilient supporting members 66, 67 are formed of an elastic material in concentric corrugated or rolled configurations, as shown in FIG. 8. These resilient supporting members 66, 67 are provided line-symmetrically and parallel to each other with respect to the centerline along the direction of thickness of the vibrating plate 65. Each of the resilient supporting members 66, 67 has its one end attached to both ends along the direction of thickness of the outer rim portions of the vibrating plate 65, while having its opposite end mounted on a ring-shaped edge ring 76 provided on the frame 58. The resilient supporting members 66, 67 support the vibrating plate 65 at a pre-set spacing from each other along the direction of thickness of the vibrating plate 65 to hold the voice coil provided in the through-hole of the vibrating plate 65 as later explained at an optimum position in the magnetic field, thus suppressing the rolling otherwise produced during large-amplitude vibrations of the vibrating plate 65. The cap 63 has an inner rim and an outer rim and is attached at its outer rim to the inner rim of the vibrating plate 65. Therefore, the cap 63 supports the inner rim of the vibrating plate 65 for movement along the amplitude direction.

Referring to FIG. 8, the magnetic circuit 57 is arranged in the through-hole of the vibrating plate 65 of the vibrating system for the mid to low sound range 56, and includes first and second voice coils 71, 72 for setting the vibrating plates 60, 65 of the vibrating system for the high sound range 55 and the vibrating system for the mid to low sound range 56, respectively, into vibrations, a center plate 73 constituting a magnetic path, and a set of magnets 74, 75 for according the magnetic flux to the center plate 73. The first voice coil 71 is mounted on the outer peripheral surface of the vibrating plate 60 of the vibrating system for the high sound range 55 so that its centerline in the winding width direction is coincident with the centerline in the direction of thickness of the vibrating plate 60. The winding width of the first voice coil 71 is selected to be not larger than the thickness of the center plate 73. The second voice coil 72 is mounted on the inner peripheral surface of the through-hole of the vibrating plate 65 ofthe vibrating system for the mid to low sound range 56 so that its centerline in the winding width direction is coincident with the centerline in the direction of thickness of the vibrating plate 65. The winding width of the second voice coil 72 is selected to be not larger than the thickness of the center plate 73. The center plate 73 is formed in a disc shape from a soft magnetic material, such as hot forged steel plate. As the magnets 74, 75, anisotropic rare earth sintered magnets, such as neodymium magnets, are used, and are formed to a disc shape having an outer diameter slightly smaller than the outer diameter of the center plate 73.

The first and second magnets 74, 75 are arranged on both sides of the center plate 73 so that the magnetic poles of repulsive polarities face each other with the center plate 73 in-between, with both ends of the center plate 73 being protruded from the outer rims of the magnets, as shown in FIG. 8. Although not shown, the center plate sides of the magnets 74, 75 are magnetized to an N-pole, with the opposite sides thereof being magnetized to an S-pole.

The magnetic circuit 57, constructed as described above, is secured by having its inner rim attached to the outer rim of the resilient supporting member 62 of the vibrating system for the high sound range 55, as shown in FIG. 8. On the outer and inner rims of the magnetic circuit 57, the second voice coil 72 for vibrating the vibrating system for the mid to low sound range 56 and the first voice coil 71 for vibrating the vibrating system for the high sound range 55 are arranged, respectively.

The frame 58 is formed of a metallic material to a substantially bottomed cylinder shape, as shown in FIG. 8. On the front end side of the frame 58 is formed a holder 79 for holding the vibrating system for the mid to low sound range 56. To this holder 79 is secured the outer rims of the resilient supporting members 66, 67 of the vibrating system for the mid to low sound range 56 via a ring-shaped edge ring 76. On the outer rim of the frame 58 is mounted a connection terminal connected via a braided wire, not shown, to the first and second voice coils 71, 72. To this connection terminal is connected a connection line to an external power source, not shown.

The speaker apparatus 3 includes a resilient supporting member 62 operating for prohibiting air in an enclosure from leaking via an interstice between the outer rim of the vibrating plate 60 and the inner rim of the magnetic circuit 57. The cap 63 also operates for prohibiting air in the enclosure from leaking out via an interstice between the through-hole n the vibrating plate 65 and the outer rim of the magnetic circuit 57.

With the above-described speaker apparatus 3, if the driving current proportionate to the speech signals is fed to the first and second voice coils 71, 72 of the magnetic circuit 57, the first and second voice coils 71, 72 are set into vibrations, in accordance with the Flemings left hand rule. The vibrating plates 60, 65 of the vibrating system for the high sound range 55 and the vibrating system for the mid to low sound range 56 are vibrated in keeping with the vibrations of the first and second voice coils 71, 72 to produce the acoustic sound. With the speaker apparatus 3, having the flat plate shaped vibrating plates 60, 65, the thicknesses of the vibrating system for the high sound range 55 and the vibrating system for the mid to low sound range 56 can be reduced further to enable the apparatus in its entirety to be reduced in thickness.

In the above-described respective speaker apparatus, the vibrating system for the high sound range and the vibrating system for the mid to low sound range are arranged on the inner and outer rim sides thereof, respectively. It is however possible to arrange the vibrating system for the high sound range and the vibrating system for the mid to low sound range in a reverse relation to each other.

Also, if the vibrating system for the high sound range and the vibrating system for the mid to low sound range are designed to reproduce different reproducing frequency ranges partially overlapped with each other, it is possible to reproduce the sound of high sound quality over a wide frequency range from the low to high ranges without fluctuations in the sound pressure level.

The present invention can be modified in a wide gamut without departing from the purport of the invention.

What is claimed is:

1. A speaker apparatus comprising:

a magnetic circuit unit having a substantially ring-shaped center plate formed of a magnetic material with chamfered edges on an inner peripheral surface thereof and a set of substantially annular magnets arranged on both sides of the center plate so that magnetic poles of repulsive polarities face each other with the center plate in-between, said magnetic circuit unit producing a magnetic field on each of an inner rim side and an outer rim side of the ring-shaped center plate;

a first vibrating system including a first vibrating plate arranged on the inner rim side of the center plate and connected to receive high sound range signals so as to be driven by said magnetic circuit unit; and a second vibrating system including a second vibrating plate arranged on the outer rim side of the center plate and connected to receive low sound range signals so as to be driven by said magnetic circuit unit.

2. The speaker apparatus according to claim 1 wherein said first and second vibrating systems have different respective reproducing frequency ranges.

3. The speaker apparatus according to claim 2 wherein said first and second vibrating systems have at least partially overlapped different respective reproducing frequency ranges and reproduce the different frequency ranges.

4. The speaker apparatus according to claim 1 wherein said center plate has a length along the vibrating direction of the inner peripheral surface smaller than a length along the vibrating direction of the outer peripheral surface in the direction parallel to the vibrating directions of the first vibrating system and the second vibrating system.

5. A speaker apparatus comprising:

a magnetic circuit unit having a substantially ring-shaped center plate formed of a magnetic material and a set of substantially annular magnets arranged on both sides of the center plate so that magnetic poles of repulsive polarities face each other with the center plate in-between, said magnetic circuit unit producing a magnetic field on each of an inner rim side and an outer rim side of the center plate;

a first vibrating system including a disc-shaped first vibrating plate arranged on the inner rim side of the ring-shaped center plate and having a first voice coil mounted on an outer peripheral surface of said disc-shaped first vibrating plate, so as to be driven by said magnetic circuit unit, wherein a winding width of said first voice coil is not larger than a thickness of said disc-shaped first vibrating plate; and a second vibrating system including a ring-shaped second vibrating plate arranged on the outer rim side of the ring-shaped center plate and having a second voice coil mounted on an inner peripheral surface of a through hole of said ring-shaped second vibrating plate, so as to be driven by said magnetic circuit unit, wherein a winding width of said second voice coil is not larger than a thickness of said ring-shaped second vibrating plate;

said first and second vibrating plates being substantially flat and plate shaped and arranged so that respective major surfaces thereof lie on substantially the same horizontal plane.

6. The speaker apparatus according to claim 5 wherein said first and second vibrating plates are arranged on the same axial line.

* * * * *